US007896451B2

(12) United States Patent
Walsh

(10) Patent No.: US 7,896,451 B2
(45) Date of Patent: Mar. 1, 2011

(54) BEVERAGE COOLER WITH STORAGE ORGANIZER

(76) Inventor: Thomas Jerome Walsh, Churchville, PA (US)

( * ) Notice: Subject to any disclaimer, the term of this patent is extended or adjusted under 35 U.S.C. 154(b) by 719 days.

(21) Appl. No.: 11/607,517

(22) Filed: Dec. 1, 2006

(65) Prior Publication Data

US 2008/0129164 A1 Jun. 5, 2008

(51) Int. Cl.
*A47B 77/08* (2006.01)

(52) U.S. Cl. ..... 312/228.1; 312/229; 312/139.2; 62/457.4

(58) Field of Classification Search ..... 312/228.1, 312/228, 229, 349, 350, 304, 139.2; 108/24, 108/25; 49/61, 63, 125, 411; 211/175, 189, 211/74; 280/47.34, 47.35, 79.11, 79.2, 79.3; 62/457.1, 457.4, 465, 440; 220/23.89, 23.87, 220/23.86, 23.83, 532, 529, 553, 523, 524, 220/525, 349, 345.5, 345.6
See application file for complete search history.

(56) References Cited

U.S. PATENT DOCUMENTS 149,224 A 3/1874 Hukill
169,854 A 11/1875 Shaw
232,998 A * 10/1880 Mitchell ..... 62/458
374,184 A 12/1887 Gardner
673,465 A 5/1901 Annin
1,287,892 A 12/1918 Corson
1,310,015 A 7/1919 Harrison
1,468,098 A 9/1923 Bauer
1,696,456 A * 12/1928 Sebring ..... 220/215
1,758,098 A 5/1930 Williams
2,083,852 A * 6/1937 McClanahan ..... 312/280
2,104,685 A * 1/1938 Wilson, Jr. ..... 62/373
2,118,099 A * 5/1938 Mirk ..... 220/345.5
2,137,822 A 11/1938 Gilmore
2,223,023 A * 11/1940 Weilemann ..... 220/345.5
2,276,635 A * 3/1942 Weber ..... 220/349
2,287,681 A * 6/1942 Hazard ..... 62/336
2,312,327 A 3/1943 Earle
2,516,122 A * 7/1950 Hughes ..... 211/184
2,569,763 A * 10/1951 Hofferberth ..... 312/295
2,572,090 A 10/1951 Allen
3,017,233 A * 1/1962 Gates ..... 312/322
3,224,823 A * 12/1965 Schulze ..... 312/108
3,237,824 A * 3/1966 Gunckel ..... 224/539
3,650,586 A * 3/1972 Nightingale et al. ..... 312/195
3,904,079 A 9/1975 Kross
4,002,383 A * 1/1977 Holloway, Jr. ..... 312/209
4,272,136 A * 6/1981 Sengua ..... 312/196
4,375,758 A * 3/1983 Simmons ..... 62/457.1
4,574,594 A * 3/1986 Simmons et al. ..... 62/457.1
4,697,855 A 10/1987 Lecher
4,739,580 A 4/1988 Simmons et al.
4,791,411 A 12/1988 Staar (Continued)

*Primary Examiner*—Darnell M Jayne
*Assistant Examiner*—Andres Gallego
(74) *Attorney, Agent, or Firm*—Paul & Paul

(57) ABSTRACT

A movable beverage cooler includes a storage organizer below an insulated cooler tub. The storage organizer has a plurality of adjustable horizontal racks for accommodating individual rows of various sized containers. The racks employ grip-in-place sidewall adjustment pads. The tub has a drop-in top, sliding door sub-assembly, with locking screws. The storage organizer may be enclosed with access through sliding doors. The structure is supported on legs with adjustable leveler extensions.

8 Claims, 3 Drawing Sheets

U.S. PATENT DOCUMENTS 4,802,340 A * 2/1989 Johnson ..... 62/229
4,842,350 A 6/1989 Collings
5,215,366 A * 6/1993 Givens ..... 312/351.3
5,251,790 A 10/1993 Cohn et al.
5,502,852 A * 4/1996 Fredman et al. ..... 5/203
5,660,117 A * 8/1997 Noble ..... 108/35
5,727,857 A * 3/1998 Smith ..... 312/114
5,743,602 A * 4/1998 Maddux et al. ..... 312/140.1
6,105,654 A 8/2000 Martel
6,151,905 A * 11/2000 Smith ..... 62/258
6,247,773 B1 * 6/2001 Harigai et al. ..... 312/405
6,299,004 B1 * 10/2001 Thalenfeld et al. ..... 211/184
6,536,609 B2 3/2003 Lake
7,216,770 B2 * 5/2007 Mueller et al. ..... 211/59.3
7,281,775 B2 * 10/2007 Yang ..... 312/348.1
2002/0108916 A1 * 8/2002 Nickerson ..... 211/59.3
2002/0190619 A1 * 12/2002 Brauer ..... 312/405
2004/0232092 A1 11/2004 Cash
2004/0239214 A1 * 12/2004 Lines et al. ..... 312/236
2005/0109245 A1 * 5/2005 Pote ..... 108/25
2007/0096416 A1 * 5/2007 Webster ..... 280/79.3

* cited by examiner

BEVERAGE COOLER WITH STORAGE ORGANIZER

BACKGROUND OF THE INVENTION

The present invention is directed to beverage storage structures and the like, and more specifically is directed to portable, non-electric coolers, used for storage, the organization and the serving of beverages.

Portable bars and movable beverage storage cabinets and chests have been constructed in many formats. The most common is a fiberglass or stainless steel rectangular tub mounted on wheels or legs which is portable enough to be carried or pushed to a serving area at a convention site, meeting site, or at a party location. These tubs are capable of holding ice as well as beverage containers and generally include a drain for emptying the ice melt.

Mixed drink server apparatus have at times incorporated dry-sinks, work tops (counter tops), and storage cabinets, with cabinet doors having catches and at times including locks. Beverage servers, such as those found in commercial taverns, often include an elongate shelf to accommodate a row of containers in single file, often known as a bartender's "well". Other beverage holders, including wine racks, have included various trays and racks. Partitions have also been used to separate various types of food and beverage in tub-type coolers.

Dispenser chutes for holding lines of beverage containers are found in vending machines. Divider rows are found in refrigeration cabinets for the display of beverages at convenience stores.

An object of the present invention is to provide a beverage cooler with storage organizer structure in a portable beverage server, which server can be used in various locations including commercial taverns and party locations.

A further object of the present invention is to provide a tub portion for holding beverage containers and ice. This tub portion has a drop-in sliding door sub-assembly.

An even further object of the present invention is to provide a series of shelves and/or racks beneath the tub portion which are easily adjustable for various container sizes.

SUMMARY OF THE INVENTION

The objects of this invention are realized in a beverage cooler apparatus having a beverage cooling insulated tub with top, sliding doors. A beverage container storage organizer is positioned beneath the tub. This storage organizer area includes a plurality of adjustable racks positioned below the tub. This area can be open-sided, or is enclosed by walls and then accessible through sliding doors. The sliding doors of both the tub and the storage organizer area are lockable.

The insulated tub has a false bottom with a plurality of drain holes. The false bottom seats over the tub bottom which drains to a drain valve. The false bottom can be a single section or plural section plate which is (are) removable for cleaning.

A "speed rail", or bartender's well, is attached to one outside wall of the insulated tub to extend generally the length of the tub at a position above the access to the storage organizer area.

The top sliding doors for the tub are carried on a drop-in frame. This frame is positioned onto the tub to seat within the upper edge of the tub. The frame also overlaps onto the top edge of the tub. Two pair of quick-turn screws, one pair on each of the opposing long sides of the frame, are used to secure the frame to the tub when they are each turned into a respective receiving hole in the inside wall of the tub.

The tub is supported by four vertical legs which are mounted to extend from the bottom of the tub when the storage organizer area is open-sided. The legs are shorter and are mounted to extend from the bottom of the enclosure about the storage organizer area, when an enclosed organizer area is employed. Each leg has a leveling and/or adjustment extension. These adjustment extensions have their projecting length fixed by a set screw, or a snap button-to-detent structure, or the like. A wheel can be fitted to the free end of each leg extension.

When the storage organizer area is open-walled, a frame bar extends about the organizer area and is attached to each vertical leg to provide a rigid structure. When the storage organizer area is enclosed with cabinet-like walls, there is no need for separate bar framing.

The organizer area has a plurality of parallel extending racks which transverse the width of the organizer area. Each rack is defined by a pair of parallel extending, vertical, side walls each carrying a lower, horizontal flange which faces inwardly. Each side wall and its attendant horizontal flange is laterally adjustable, i.e., movable along the long/longitudinal length of the tub/cooler. This adjustment permits the rack widths to be individually adjustable to accommodate various size/width containers.

The bottom horizontal flange on each vertical wall rides in a horizontal slot which extends along the inside, bottom edge of each long/longitudinal frame bar, when an open organizer area configuration is employed, and along the inside, bottom edge of each long/longitudinal wall, when an enclosed organizer area configuration is employed.

Friction pads may be utilized where each vertical wall, horizontal flange engages a horizontal slot. These pads permit the walls of the racks to be manually moved to accommodate specific sizes of containers, but also provide a "grip-in-place" after this adjustment is made.

BRIEF DESCRIPTION OF THE DRAWINGS

The features, advantage and operation of the present invention will become readily apparent and further understood from a reading of the following detailed description with the accompanying drawings, in which like numerals refer to like elements, and in which.

DETAILED DESCRIPTION OF THE INVENTION

Figures 1, 3, 4:
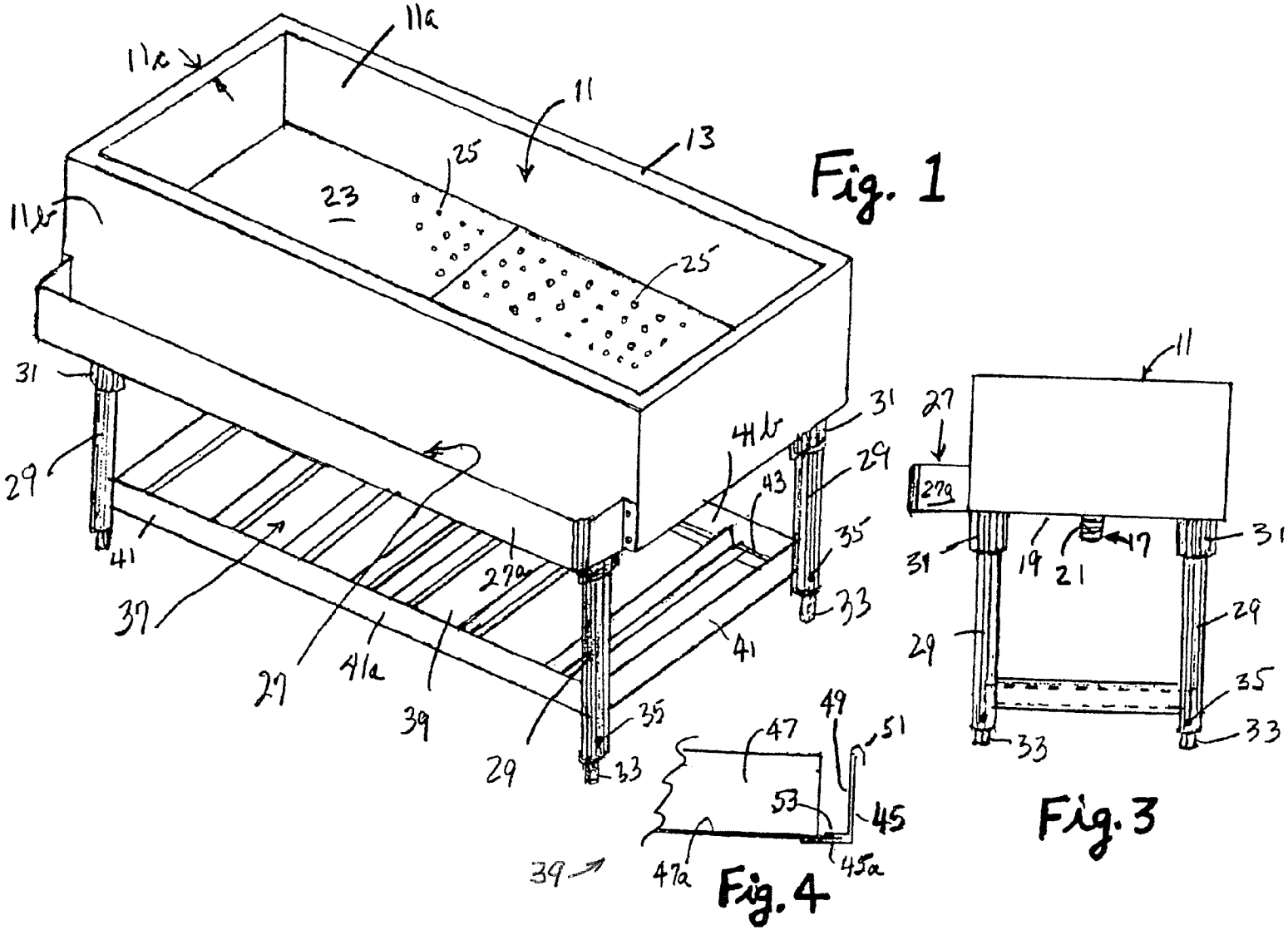
FIG. 1 is a perspective view of the beverage cooler with an open-walled container storage organizer.
FIG. 3 is a side view of the cooler and storage organizer of FIG. 1.
FIG. 4 is a partial side view of an organizer rack side wall and hanger for the open-walled storage organizer configuration of FIG. 1.

The present invention is a movable beverage cooler, FIG. 1, having an insulated rectangular tub 11 member for holding ice and beverage containers such as bottles and cans. The cooler can be made of any suitable material. However, for restaurant use stainless steel is the material of preference. The tub 11 has an inner wall 11*a* and an outer wall 11*b*, and a thickness 11*c* defined by the thickness of the insulation between the inner and outer walls 11*a*, 11*b*, and the thickness of the metal used for construction. The wall thickness provides an upper edge 13 for supporting a drop-in frame 15 discussed below in connection to FIGS. 9 and 10.

While the beverage cooler and its tub 11 can be constructed with many shapes, a rectangular shape is well suited both for restaurant and home use. The size of the cooler and its dimensions including length to width and height relationships can be varied to provide various capacities and to fit into various locations.

The tub has a drain extension 17, FIG. 3, in its bottom wall 19 which can carry a series of annular outwardly extending ribs 21 on its outer wall for receiving a pliable drain hose and sealing-off thereto. A drain valve (not shown) can be included with the drain extension 17. The bottom 19 of the tub is formed to drain to the drain extension 17 in a usual manner for sinks and tubs.

Positioned above the tub bottom 19 is a false bottom 23. This false bottom 23 is made of perforated sheet metal having a series of drain holes 25 spaced over the entirety of its expanse. The drain holes 25 are sized to allow melt water from ice held in the tub 11 to drain to the bottom 19 while keeping reasonably small ice pieces in the body of the tub 11. The false bottom 23 is rigid enough to support a tub full of containers and ice. A series of reinforcing ribs (not shown) or other type of "stand-off" can be attached to the bottom side of the false bottom 23 and be used to space the false bottom 23 above the tub draining bottom wall 19. Such stand-off ribs will also reinforce the sheet metal to provide rigidity.

A tray enclosure 27 known as a "speed rail" or bartender's well is attached to the front outside wall of the tub 11 to extend the length thereof. This speed rail 27 has an outside wall 27*a* and a bottom wall (not shown in FIG. 1) and comprises a shelf for holding often used containers and bottles.

Four legs 29, FIGS. 1, 3, support the tub bottom 19. Each leg 29 fits into a support member 31, FIG. 1, which is welded to the tub bottom 19 at a respective corner. A support member 31 provides a socket into which a leg 29 fits in a tight fit. The support member 31 socket extends downward a sufficient distance to provide lateral stability to the leg 29. A leg 29 may be attached to its support member 31 socket with a screw or welded in place, or may be left unsecured. When the legs 29 are merely inserted into their respective sockets, the beverage cooler may be disassembled into two main sub-assembly pieces for storage, moving, or cleaning.

A leveler extension post 33 extends out from the bottom of each leg 29. The downward extension length of each leveler post 33 is set by a screw 35 or a snap button-to-detent structure. A set screw 35 will provide a more infinite adjustment to a leveler post's extension than a detent arrangement which requires a series of fixed spaced detent points.

A storage organizer area 37 is situated below the tub 11. This organizer area 37 has a plurality of parallel extending racks 39 which transverse the width of the organizer area 37. Each rack is defined by a pair of upstanding side walls, a back wall, a front wall and a pair of juxtaposed bottom flanges, which will be discussed below, further. Surrounding the organizer area 37 is a frame bar 41 which is welded to the inner face of each of the legs 29 to form a rectangular four-sided frame. This frame bar 41 can be a flat bar surround, which forms the front and back walls of the racks 39 and the side walls of the outer most rack 39.

A horizontal slot 43 extends along the inside face of the front wall 41*a* and the inside face of the back wall 41*b* of the frame bar 41. As an alternative to being a flat bar, the frame bar 41 can be an L-shaped frame channel 45, FIG. 4. The bottom flange 45*a* of this L-shaped channel 45 forms a "rest" surface for holding each rack separator wall 47, FIG. 4, in position. Each separator wall 47 is a rectangular plate with a bottom flange 47*a* which forms an inverted T-shaped channel. The bottom flange 47*a* of the T-shaped channel extends beyond the end of the separator wall 47 to rest on the bottom flange 45*a* of each L-shaped frame channel 45, FIG. 4.

A spring steel, L-shaped channel keeper 49 seats down over the inside of the L-shaped frame channel 45, with one keeper member 49, respectively, for each of the front wall 41*a* and the back wall 41*b* of the frame channel 45. The top edge of this keeper member has a spring clip portion 51. When this clip portion 51 is fully seated onto the upper edge of the upright wall of a respective L-shaped frame channel portion 45, the bottom flange 53 of the keeper 49 exerts a hold-down pressure on each separator wall bottom flange 47*a* extension.

Each of the separator walls 47 can be laterally moved to set the width of a particular parallel rack 39. Each rack 39 can have its individual width established by the position of the adjacent separator walls 47. The size (extension) of each bottom flange 47*a*, connected to each separator wall 47, can be chosen so that the range of adjustment between adjacent separator walls suits the container sizes to be held by the storage organizer. The front and back channel keepers 49 are removable for cleaning, and for facilitating the setup of the individual racks 39.

The beverage cooler of FIG. 1 can have an enclosed storage organizer area. In order to accomplish this, the left and right side walls 57, 59 and the back wall 61, of the tub 11 are extended downward to meet a base wall 63, FIGS. 2 and 5. The opening in the front of the organizer enclosure 55 is closed by a pair of slider doors 65*a* and 65*b*, FIG. 2. A pair of slider tracks (channel tracks not shown) is positioned in the bottom edge of the front wall 65 above the opening into the organizer area 55. This provides sufficient guides for the sliding doors 65*a* and 65*b*. The doors 65*a* and 65*b* may be locked by means of a key lock 67. Each of the doors can be moved by means of its handle 69.

This configuration leaves the threshold 71 clear and flat and easy to clean.

Figures 2, 5, 6, 7, 8:
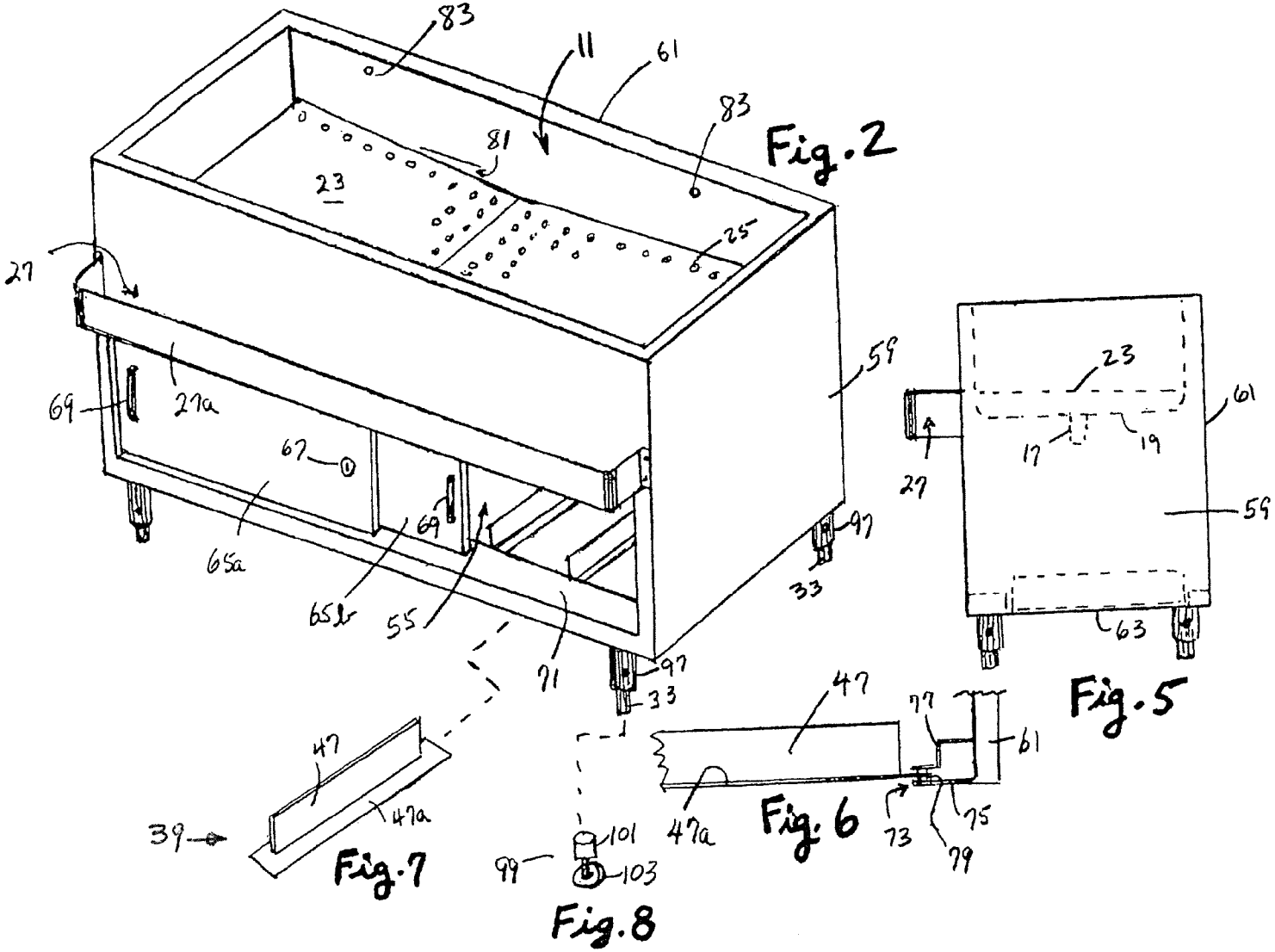
FIG. 2 is a perspective view of the beverage cooler with a walled container storage organizer.
FIG. 5 is a side view of the cooler and storage organizer of FIG. 2.
FIG. 6 is a partial side view of an organizer rack side wall and mating slot structure.
FIG. 7 is a perspective view of a rack side wall for the embodiments of FIGS. 1 and 2.
FIG. 8 is a side view of a wheel attachment for a cooler support leg.

The separator walls 47, FIG. 7, used with the enclosed organizer 55, FIG. 2, are the same as those used with the open organizer area 37, FIG. 1. These inverted T-shaped structures 47 have their bottom flange 47*a* sized to extend outwardly from each side of the separator wall 47 a sufficient distance to provide for the containers stored between adjacent walls 47 and thereby form a rack 39. The bottom flange 47*a* also extends beyond the wall 47 to engage the front and back horizontal slots 73, FIG. 6. Each horizontal slot 73 is defined by, either the base wall 63, or by an inward extending flange 75 extending from the outside wall (such as back wall 61) and a stepped cap 77. A cap 77 can be fixedly attached to a respective wall by screws or other suitable means or can snap into place by means of detents, clip members, or other suitable structures.

A pair of rubber or plastic friction pads 79 can be positioned on the top and bottom faces of the each separator wall flange 47*a* end to hold a separator wall 47 in place once its position is manually adjusted. These pads provide grip-in-place.

The false bottom 23, FIG. 2, can be pitched at an angle 81 to aid draining to a particular location on the tub bottom 19.

Interior walls of the tub 11, such as the front and back walls can carry a plurality of threaded or slotted holes 83 for receiving securement screws.

Figure 9:
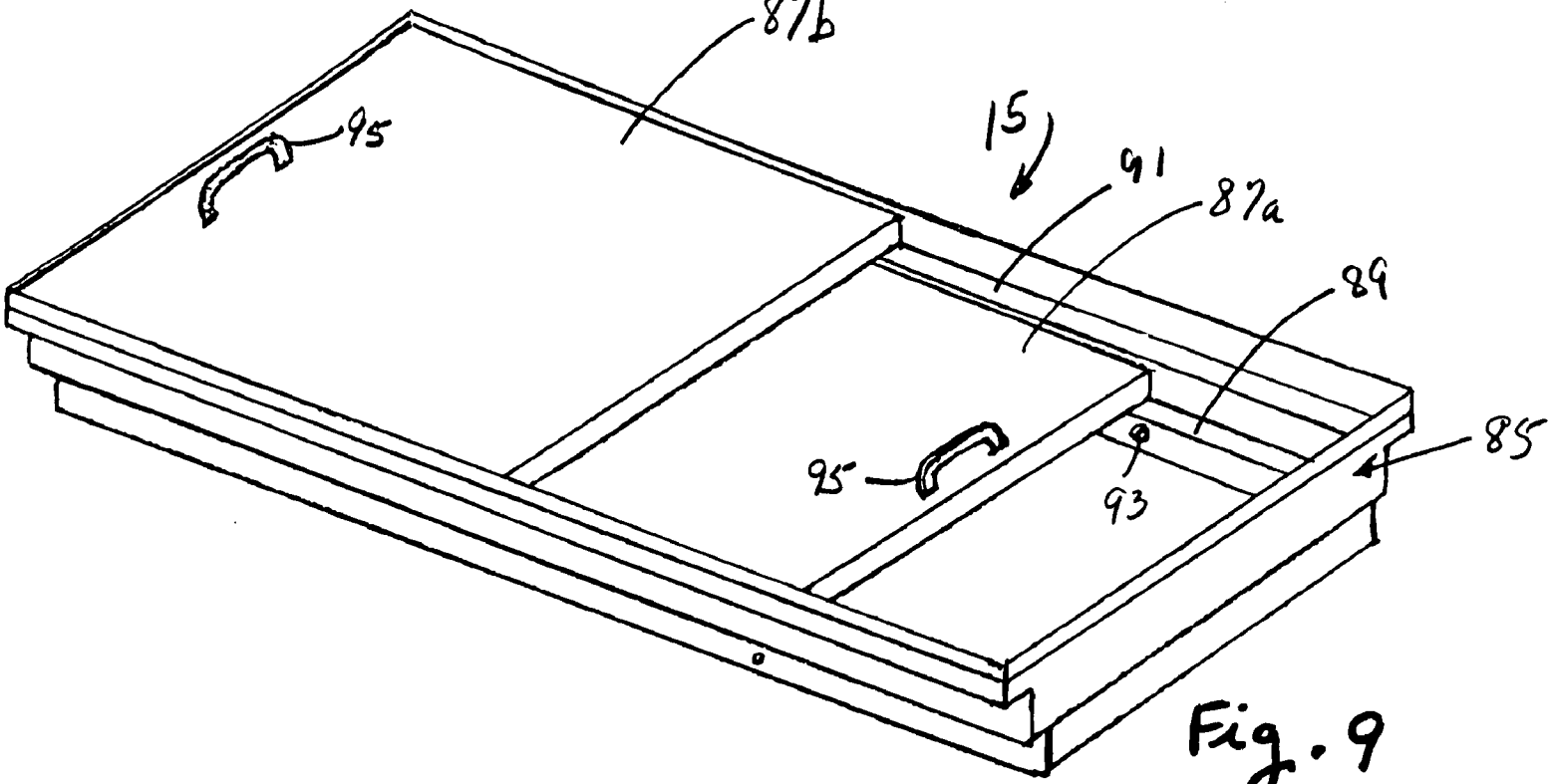
FIG. 9 is a perspective view of the drop-in frame with top sliding doors for the cooler embodiments of FIGS. 1 and 2.
Figure 10:
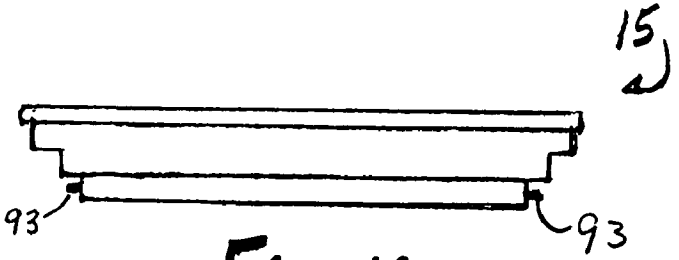
FIG. 10 is a side view of the drop-in frame of FIG. 9.

The insulated, drop-in top frame 15, FIGS. 9 and 10 is a sub-assembly of a double step-in frame 85 and a pair of insulated sliding doors 87*a* and 87*b*. The inner door 87*a* slides on a lower ledge 89, delineated by a lower, inward step in the frame 85. The outer door 87*b* slides on an upper ledge 91, delineated by an upper, outward step in the frame 85. A series of fasteners 93 are positioned below the lower ledge 89 for securing the frame 85 to the inside walls of the tub 11. This enables the employment of a lock bar to lock the sliding doors 87*a* and 87*b* by means of their handles 95.

The fasteners can be of many commercial styles, including quarter turn fasteners, threaded cap screws and other securements.

The legs 97, FIG. 2, for the enclosed organizer embodiment, can include leveler extension posts 33 and adjustment set screws 97. Wheel assemblies 99 can be mounted to the bottom end of each leveler post 33. Each wheel assembly includes a cup-shaped socket 101 and a roller or wheel 103 supported thereon.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

What is claimed is:

1. A beverage cooler and storage organizer apparatus, comprising:

a beverage cooling tub having a bottom wall; and a front and rear walled container storage organizer attached below said tub, said storage organizer having an open bottom and having a plurality of parallel extending racks extending between said front and rear walls, said racks each being individually adjustable for width;

wherein each of said parallel extending racks is defined by a pair of parallel juxtaposed upstanding separator walls and a pair of juxtaposed flanges with a longitudinal opening there between, said juxtaposed flanges extending horizontally from the bottom of a respective upstanding separator wall and forming a support surface for said containers, wherein said juxtaposed flanges are slidably adjustable as to a first space between said separator walls and the width of the longitudinal opening there between and to thereafter be fixedly positioned;

wherein each said rack separator wall has said juxtaposed flange extending on each side from the bottom edge thereof forming an inverted T-shaped member wherein a web of said T-shaped member is said upstanding separator wall and wherein the juxtaposed flanges have a flange extension extending beyond each end of said upstanding separator wall;

wherein said storage organizer includes a pair of horizontal slots each extending the length of the inside face of the front and rear walls of said storage organizer, respectively;

wherein each said slot is delineated by a lower horizontal flange and an upper horizontal flange with a second space there between, said lower horizontal flange and said upper horizontal flange extending into the container storage organizer;

wherein each of said juxtaposed flanges which extend beyond each end of said separator wall is positioned in a respective slot and sits on said lower horizontal flange;

wherein said upper horizontal flange is formed by a cap; and wherein said cap is snapped into position to form said slot and is removable therefrom.

2. The apparatus of claim 1 also including at least one friction pad positioned within each said slot in contact with each said flange extension positioned within the slot and in contact with one of said upper and lower horizontal flanges forming the slot.

3. The apparatus of claim 1, wherein said tub has a drop-in, removable, top sliding door assembly including a drop in, removable double step-in frame having lower and upper ledges and a pair of removable sliding doors, being an inner door and an outer door, wherein said inner door slides on said lower ledge, and said outer door slides on said upper ledge; and wherein said frame is fixedly secured to the inside of said tub walls with removable fasteners.

4. The apparatus of claim 3, wherein said removable fasteners are positioned below said drop-In frame lower ledge.

5. The apparatus of claim 4, also including four detented, incrementally extensible support legs, each leg having at its bottom end a separate fixable, extensible, leveler post; the apparatus also including handles on each of said inner and outer sliding doors.

6. The apparatus of claim 5, also including four leg support sockets each mounted to said tub bottom wall, wherein a respective one of each said legs is held by a respective one of said support sockets.

7. A beverage cooler and storage organizer apparatus, comprising:

an insulated tub;

a container storage organizer having an open bottom and being positioned beneath said insulated tub, said container storage organizer having a plurality of parallel extending racks for holding containers, each said rack being individually adjustable for a desired container width providing a longitudinal opening between pairs of racks to the open bottom, wherein each said rack of said pair of racks include a separator wall and juxtaposed rack flange surfaces for holding said containers, wherein said juxtaposed rack flange surfaces extend longitudinally along each said separator wall to extend beyond each end of said separator wall;

wherein said container storage organizer has an upstanding front and back wall and a front and back wall flange extending horizontally inwardly along each of said front and back walls, respectively;

wherein said juxtaposed rack flange surfaces extending beyond a said separator wall engage said front and back wall flanges to rest thereon and to be slidably moveable there along; and a securement member securely fixing each said juxtaposed rack flange surface engaging said front and back wall flanges at a desired location on said front and back wall flanges and for releasing said rack flange for sliding along a said wall flange; and wherein said tub is rectangular, and has a drain in the middle of the bottom thereof;

also including a perforated false bottom, said false bottom being in two adjoining sections each being pitched to the middle of said tub; and wherein said securement member includes friction members and a member having a spring portion.

8. A beverage cooler and storage organizer apparatus, comprising:

an insulated tub;

a container storage organizer having an open bottom and being positioned beneath said insulated tub, said container storage organizer having a plurality of parallel extending racks for holding containers, each said rack being individually adjustable for a desired container width providing a longitudinal opening between pairs of racks to the open bottom, wherein each said rack of said pair of racks include a separator wall and juxtaposed rack flange surfaces for holding said containers, wherein said juxtaposed rack flange surfaces extend longitudinally along each said separator wall to extend beyond each end of a said separator wall;

wherein said container storage organizer has an upstanding front and back wall and a front and back wall flange extending horizontally inwardly along each of said front and back walls, respectively;

wherein said juxtaposed rack flange surfaces extending beyond each said separator wall engage said front and back wall flanges to rest thereon and to be slidably moveable there along; and a securement member securely fixing each juxtaposed rack flange surface engaging said front and back wall flanges at a desired location on said front and back wall flanges and for releasing said rack flange for sliding along a said wall flange; and wherein said tub is rectangular, and has a drain in the middle of the bottom thereof;

also including a perforated false bottom, said false bottom being in two adjoining sections each being pitched to the middle of said tub; and wherein said securement member includes a member having a spring portion.

* * * * *